US007134891B2

(12) United States Patent
Kayama et al.

(10) Patent No.: US 7,134,891 B2
(45) Date of Patent: Nov. 14, 2006

(54) FLAT CABLE AND CONNECTOR AS WELL AS ELECTRONIC DEVICE

(75) Inventors: Shun Kayama, Saitama (JP); Yukiko Shimizu, Saitama (JP); Masayoshi Iida, Tokyo (JP); Tomisaburo Yamaguchi, Kanagawa (JP); Shinsuke Kunishi, Kanagawa (JP); Akira Aso, Kanagawa (JP)

(73) Assignees: Sony Corporation, Tokyo (JP); Molex Japan Co., Ltd., Yamato (JP)

( * ) Notice: Subject to any disclaimer, the term of this patent is extended or adjusted under 35 U.S.C. 154(b) by 0 days.

(21) Appl. No.: 10/938,581

(22) Filed: Sep. 13, 2004

(65) Prior Publication Data

US 2005/0208824 A1 Sep. 22, 2005

(30) Foreign Application Priority Data

Sep. 19, 2003 (JP) ..... P2003-327498
Nov. 17, 2003 (JP) ..... P2003-386173

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 4,172,626 A * 10/1979 Olsson ..... 439/329
4,639,063 A * 1/1987 Mueller ..... 439/325
4,892,487 A * 1/1990 Dranchak et al. ..... 439/260
5,181,853 A * 1/1993 Van Brunt et al. ..... 439/67
5,924,891 A * 7/1999 Benjamin et al. ..... 439/495
5,993,247 A * 11/1999 Kidd ..... 439/495
6,089,905 A * 7/2000 Shimmyo et al. ..... 439/495
6,244,890 B1 * 6/2001 Fuerst et al. ..... 439/357
6,352,442 B1 * 3/2002 Kudo ..... 439/260
6,773,287 B1 * 8/2004 Takashita ..... 439/260
6,932,642 B1 * 8/2005 Beer et al. ..... 439/495

FOREIGN PATENT DOCUMENTS

JP 10-093212 4/1998
JP 2003/092457 3/2003

* cited by examiner

*Primary Examiner*—Gary F. Pauman
(74) *Attorney, Agent, or Firm*—Oblon, Spivak, McClelland, Maier & Neustadt, P.C.

(57) ABSTRACT

A connector 1 according to the invention comprises a main body 10 for receiving the front end of a flat cable 2 being inserted therein, a movable pressurizing member 11 adapted to press and rigidly secure in position the flat cable 2 inserted into the main body 10 and projections 13 arranged either on the main body 10 or on the pressurizing member 11 so as to be engaged respectively with the corresponding holes 23 of the flat cable 2 when the front end of the flat cable is inserted into the connector 1 to take a right position in the connector 1. The flat cable 2 comprises a flexible base member 21 and wires 22 formed in the flexible base member 21, the flexible base member 21 being provided with holes 23 to be engaged respectively with the corresponding projections 13 arranged in the connector 1 when the flexible base member 21 is inserted into the connector 1 to take a right position in the connector 1.

5 Claims, 15 Drawing Sheets

FLAT CABLE AND CONNECTOR AS WELL AS ELECTRONIC DEVICE

BACKGROUND OF THE INVENTION

1. Field of the Invention

This invention relates to a flat cable formed by arranging wires in a flexible base member and also to a connector for receiving and rigidly securing such a flat cable as well as to an electronic device using such a connector for electric connection.

The present application claims priority from Japanese Patent Application No. P2003-327498 filed on Sep. 19, 2003, and No. P2003-386173 filed on Nov. 17, 2003, the content of which is hereby incorporated by reference into this application.

2. Related Background Art

Many flat cables have been and being used for electrically connecting circuit boards. Such a flat cable is formed by arranging a plurality of wires in parallel with each other in a flexible base member of an electrically insulating material and adapted to be effectively used for wiring and electrically connecting circuit boards with or without movable parts interposed between them.

Generally, a flat cable is rigidly secured to a connector by inserting the flat cable into the connector in a right direction until the former abuts the latter, which is then pressed by means of a press member. For this operation, the operator needs to visually ensure that the flat cable has been inserted to the right position in the connector.

A flat cable to be mounted into a connector by cutting a hole through the flat cable at an engagement section thereof to be engaged with the connector is disclosed in Japanese Patent Application Laid-Open Publication No. 10-93212 and also in Japanese Patent Application Laid-Open Publication No. 2003-92457.

However, any of the above-cited known flat cables needs a jig to be used when it is fitted to a connector. The use of a jig makes the operation of fitting a flat cable to a connector a cumbersome one. Additionally, there arise problems including that the flat cable is inserted incompletely into the connector and/or fitted to the latter aslant more often than not.

SUMMARY OF THE INVENTION

The present invention is made to dissolve the above-identified problems of the prior art.

In an aspect of the invention, there is provided a flat cable comprising: a flexible base member; and wires formed in the flexible base member; the wires being adapted to be electrically connected to the corresponding respective contacts of an external connector when the front end of the flexible base member is inserted into the connector; the flexible base member being provided with holes to be engaged respectively with corresponding projections arranged in the connector when the flexible base member is inserted into the connector to take a right position in the connector.

In another aspect of the invention, there is provided a connector comprising: a main body for receiving the front end of a flat cable being inserted therein; a movable pressurizing member adapted to press and rigidly secure in position the flat cable inserted into the main body; and projections arranged either on the main body or on the pressurizing member so as to be engaged respectively with the corresponding holes of the flat cable when the front end of the flat cable is inserted into the connector to take a right position in the connector.

In still another aspect of the invention, there is provided an electronic device comprising a connector fitted to a circuit board and a flat cable to be inserted into the connector and rigidly secured in position and adapted so as to align the flat cable and the connector by respective engagement of the holes arranged in the flat cable and the corresponding projection arranged on the connector when the flat cable is inserted into the connector to take a right position in the connector.

Thus, when a flat cable according to the invention is inserted into a connector according to the invention, the holes arranged in the flexible base member are engaged respectively with the corresponding projections arranged in the connector and the wires are reliably electrically connected to the corresponding respective contacts of the connector only when the flat cable is inserted into the connector to take a right position in the connector.

In still another aspect of the invention, there is provided a flat cable comprising: a flexible base member; and wires formed in the flexible base member; the wires being adapted to be electrically connected to an external connector when the front end of the flexible base member is inserted into the connector; the flexible base member being provided with lateral extended sections to be engaged respectively with corresponding projections arranged in the connector when the flexible base member is inserted into the connector.

In another aspect of the invention, there is provided a connector comprising: a main body for receiving the front end of a flat cable being inserted therein; a movable pressurizing member adapted to press and rigidly secure in position the flat cable inserted into the main body; and projections arranged on the main body so as to be engaged respectively with the corresponding extended sections arranged on the flat cable to control the position of the flat cable when the flat cable is inserted into the connector.

In still another aspect of the invention, there is provided an electronic device comprising a connector fitted to a circuit board and a flat cable to be inserted into the connector and rigidly secured in position and adapted so as to align the flat cable and the connector by respective engagement of the lateral extended sections arranged on the flat cable and the corresponding projection arranged on the connector when the flat cable is inserted into the connector to take a right position in the connector.

Thus, when a flat cable according to the invention is inserted into a connector according to the invention, the extended sections arranged in the flexible base member are engaged respectively with the corresponding projections arranged in the connector and the wires are reliably electrically connected to the corresponding respective contacts of the connector only when the flat cable is inserted into the connector to take a right position in the connector.

In still another aspect of the invention, there is provided a flat cable comprising: a flexible base member; and wires formed in the flexible base member; the wires being adapted to be electrically connected to an external connector when the front end of the flexible base member is inserted into the connector; the flexible base member being provided with lateral stepped sections to be engaged respectively with corresponding projections arranged in the connector when the flexible base member is inserted into the connector.

In another aspect of the invention, there is provided a connector comprising: a main body for receiving the front end of a flat cable being inserted therein; a movable pressurizing member adapted to press and rigidly secure in position the flat cable inserted into the main body; and projections arranged on the main body so as to be engaged respectively with the corresponding stepped sections arranged on the flat cable to control the position of the flat cable when the flat cable is inserted into the connector.

In still another aspect of the invention, there is provided an electronic device comprising a connector fitted to a circuit board and a flat cable to be inserted into the connector and rigidly secured in position and adapted so as to align the flat cable and the connector by respective engagement of the lateral stepped sections arranged on the flat cable and the corresponding projection arranged on the connector when the flat cable is inserted into the connector to take a right position in the connector.

Thus, when a flat cable according to the invention is inserted into a connector according to the invention, the stepped sections arranged in the flexible base member are engaged respectively with the corresponding projections arranged in the connector and the wires are reliably electrically connected to the corresponding respective contacts of the connector only when the flat cable is inserted into the connector to take a right position in the connector.

Therefore, when a flat cable according to the invention is inserted into a corresponding connector according to the invention, it is accurately aligned with the connector so that the operator can easily fit the flat cable to the connector. Additionally, since the flat cable is free from the problem that the flat cable is inserted incompletely into the connector and/or fitted to the latter aslant, it is possible to arrange the wires of the flat cable at a fine pitch. As a result, it is possible to realize downsizing and a high degree of integration of flat cables, connectors and electronic devices.

DETAILED DESCRIPTION OF THE PREFERRED EMBODIMENTS

Now, the present invention will be described in greater detail by referring to the accompanying drawings that illustrate preferred embodiments of the invention.

Figure 1:
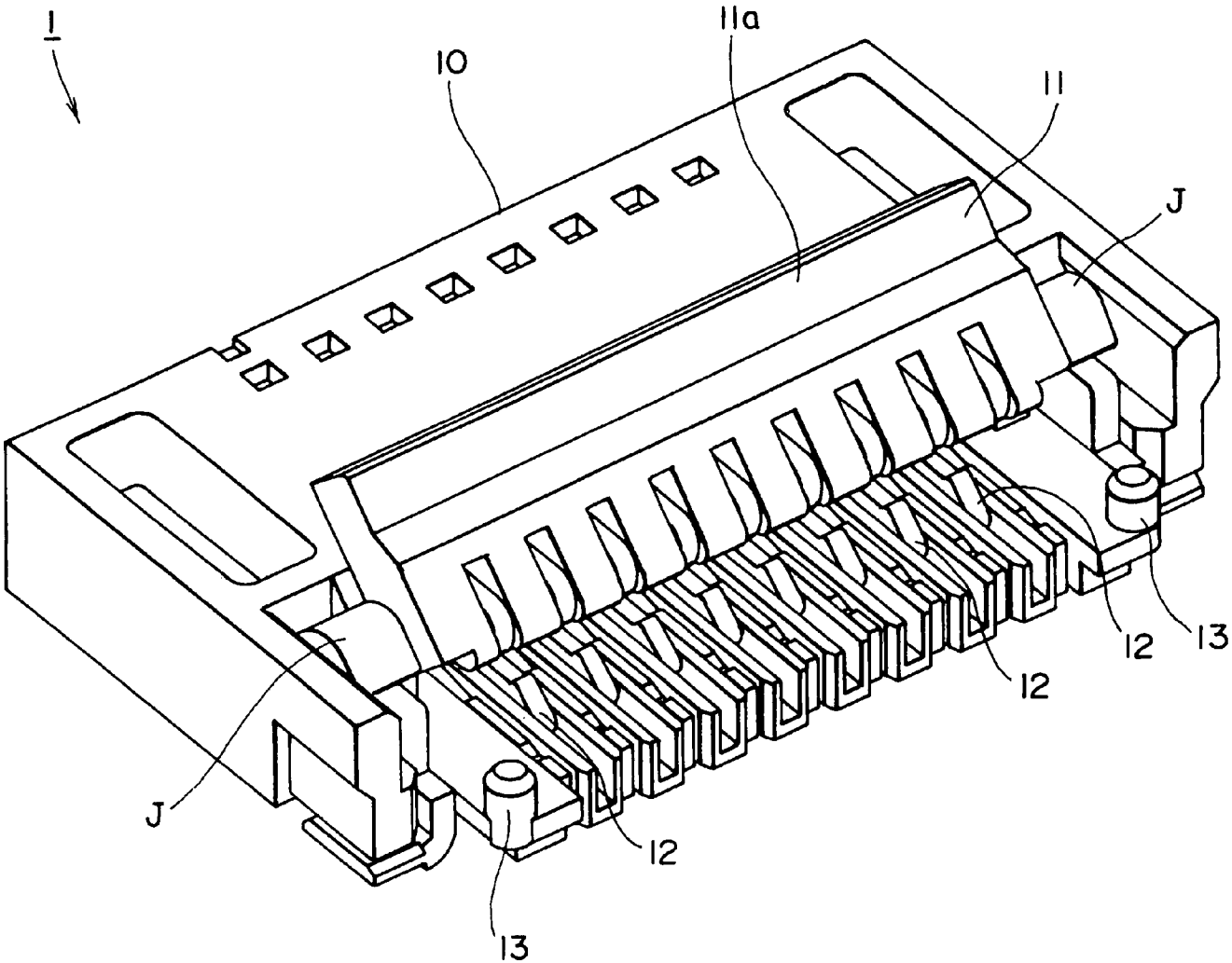
FIG. 1 is a schematic perspective view of the first embodiment of connector according to the invention.

FIG. 1 is a schematic perspective view of the first embodiment of connector according to the invention. Referring to FIG. 1, the connector 1 comprises a main body 10 adapted to receive a flat cable, which will be described in greater detail hereinafter and is to be inserted into it, and a movable pressurizing member 11 adapted to press and rigidly hold the flat cable in a state where the flat cable is inserted into the main body 10.

The main body 10 is provided at the position for receiving the flat cable with contacts 12 to be used for establishing electric connection with the flat cable. A plurality of contacts 12 are arranged so as to be insulated from each other and each of the contacts 12 has a bent and upwardly projecting profile so as to make itself resilient and operate like a spring. With this arrangement, when the flat cable is inserted into the main body 10, the wires of the flat cable reliably contact the corresponding respective contacts 12 of the connector 1 due to the resiliency of the contacts 12.

The pressurizing member 11 has a keep plate 11*a*, which is opened and closed as the pressurizing member 11 is turned around an axis J. The flat cable is pinched in the main body 10 as the keep plate 11*a* of the pressurizing member 11 is closed so that the flat cable is reliably prevented from being pulled out.

The connector 1 of this embodiment is additionally provided with lateral projections 13 at respective positions located close to the part for receiving the flat cable inserted into it. These projections 13 are for aligning the connector and the flat cable. More specifically, the projections 13 come to be engaged with the holes arranged in the flat cable when the flat cable is inserted into the main body 10 and takes a right position in the main body 10. As a result, it is possible to ensure that the flat cable is accurately inserted into the right position in the connector 1.

Figure 2:
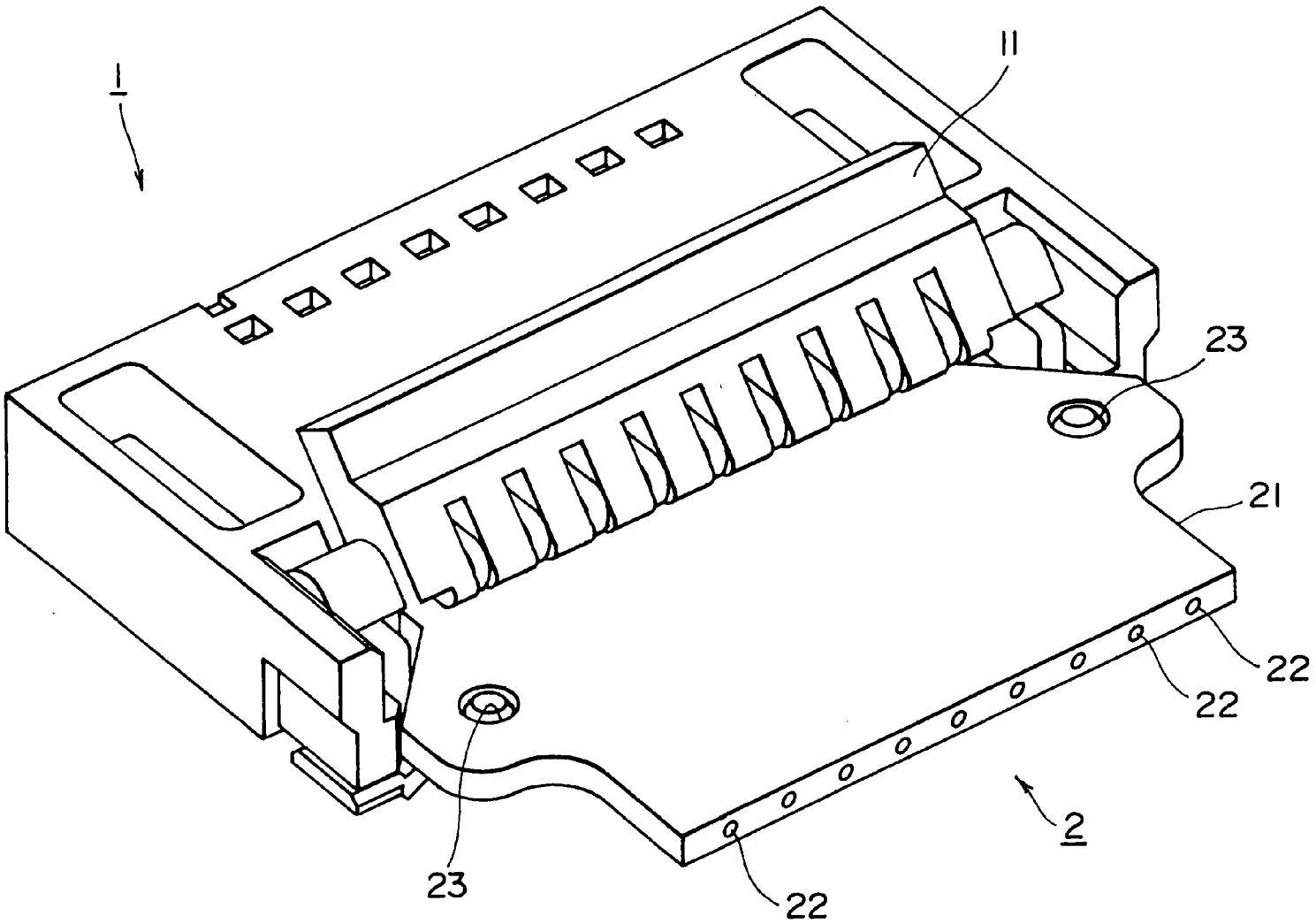
FIG. 2 is a schematic perspective view of the first embodiment of flat cable and connector according to the invention.

FIG. 2 is a schematic perspective view of the first embodiment of flat cable and connector according to the invention. As pointed out above, the main body 11 of the connector 1 of this embodiment is provided with lateral projections 13 at respective positions located close to the part for receiving the flat cable inserted into it. The flat cable 2 of this embodiment is provided with holes 23 at positions that respectively correspond to those of the projections 13.

The flat cable 2 comprises a flexible base member 21 and a plurality of wires 22 arranged in the flexible base member 21. The flexible base member 21 is electrically insulating and the plurality of wires 22 are insulated from each other by the flexible base member 21.

The holes 23 of the flat cable 2 are formed in edge areas as viewed in a lateral direction where the wires 22 of the flexible base member 21 are not arranged. The expression of lateral direction as used herein refers to a direction that is substantially perpendicular to the direction in which the flexible base member 21 is inserted into the connector (substantially perpendicular to the direction in which the wires 22 extend). As the flat cable 2 is inserted into the main body 10 of the connector 1 and the projections 13 of the connector 1 are inserted into the respective holes 23, the depth of insertion of the flat cable 2 in the connector 1 and the inclination of the inserted flat cable 2 relative to the connector 1 are automatically defined so that the wires 22 of the flat cable 2 are reliably held in contact with the corresponding respective contacts 12 of the connector 1. The projections 13 will be received reliably by the respective holes 23 of the flat cable 2 when the projections 13 of the connector are tapered toward the front ends thereof.

As the pressurizing member 11 is closed after inserting the flat cable 2 into the connector 1 so as to bring the holes 23 into engagement with the respective projections 13, the flat cable 2 is pinched and reliably fitted to the connector 1 to produce a state where the flat cable 2 is accurately aligned with the connector 1.

If, on the other hand, the holes 23 of the flat cable 2 and the corresponding respective projections 13 of the connector 1 are not engaged (and the holes 23 are located off the corresponding respective projections 13), it is not possible to completely close the pressurizing member 11. Because the pressurizing member 11 cannot be closed unless the holes 23 of the flat cable 2 and the projections 13 of the connector 1 are engaged, the flat cable 2 is prevented from being rigidly fitted to the connector 1 in a state where it is incompletely inserted into the connector 1.

Figure 3:
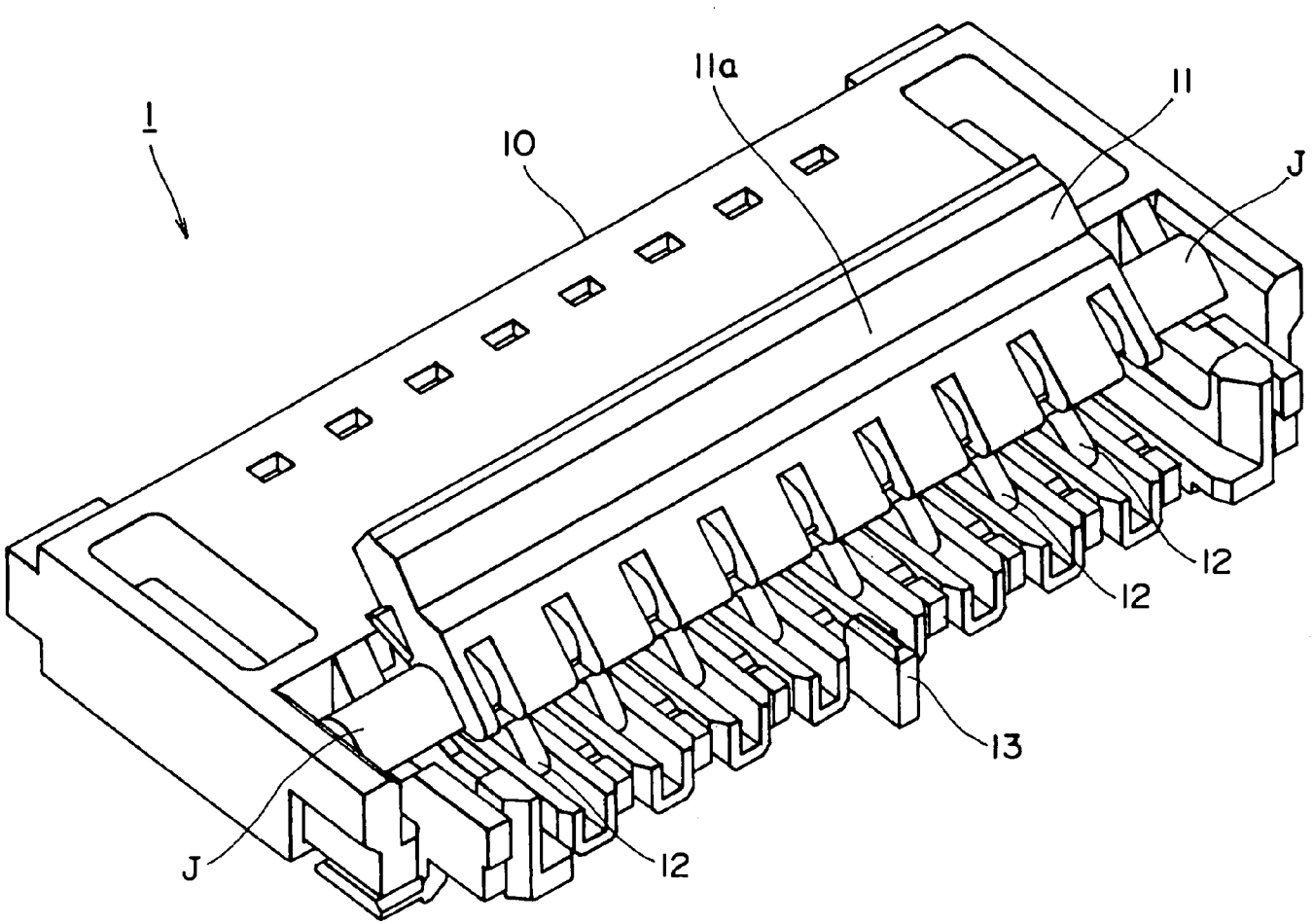
FIG. 3 is a schematic perspective view of the second embodiment of connector according to the invention.

FIG. 3 is a schematic perspective view of the second embodiment of connector according to the invention. Referring to FIG. 3, like the connector 1 of the above described first embodiment, the connector 1 comprises a main body 10 adapted to receive a flat cable and a movable pressurizing member 11 adapted to press and rigidly hold the flat cable in a state where the flat cable is inserted into the main body 10. However, this embodiment differs from the first embodiment in that the main body 10 is provided with a single projection 13 to be used for aligning the connector 1 with a flat cable that is arranged substantially at the center as viewed in a lateral direction of the flat cable.

The main body 10 of the connector 1 of the second embodiment is also provided at the position for receiving the flat cable with contacts 12 to be used for establishing electric connection with the flat cable. A plurality of contacts 12 are arranged so as to be insulated from each other and each of the contacts 12 has a bent and upwardly projecting profile so as to make itself resilient and operate like a spring. With this arrangement, when the flat cable is inserted into the main body 10, the wires of the flat cable reliably contact the corresponding respective contacts 12 of the connector 1 due to the resiliency of the contacts 12.

The pressurizing member 11 has a keep plate 11*a*, which is opened and closed as the pressurizing member 11 is turned around an axis J. The flat cable is pinched in the main body 10 as the keep plate 11*a* of the pressurizing member 11 is closed so that the flat cable is reliably prevented from being pulled out.

The single projection 13 arranged on the connector 1 comes to be engaged with the hole arranged in the flat cable when the flat cable is inserted into the main body 10 and takes a right position in the main body 10. As a result, it is possible to ensure that the flat cable is accurately inserted into the right position in the connector 1.

Figure 4:
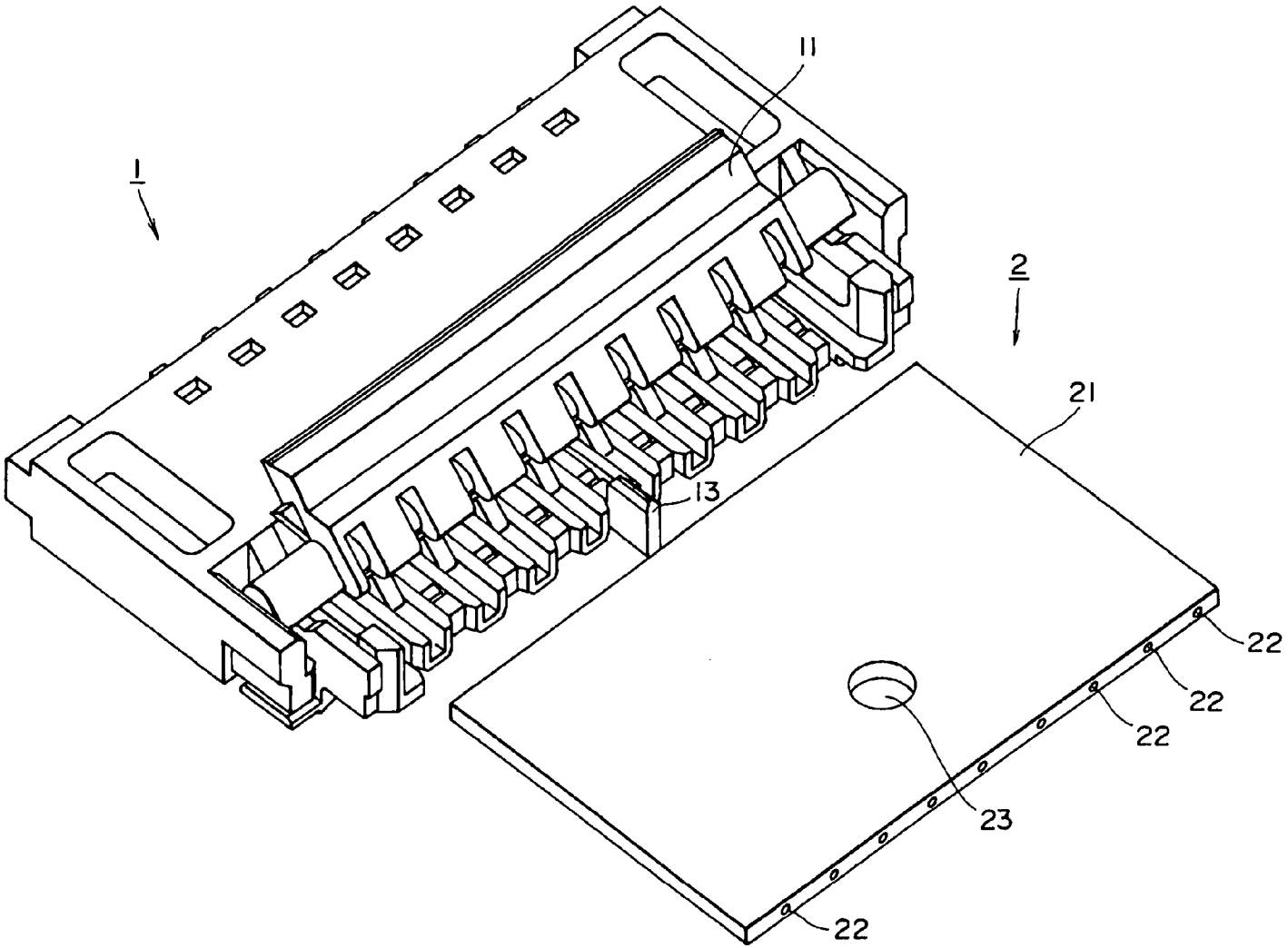
FIG. 4 is a schematic perspective view of the second embodiment of flat cable and connector according to the invention.

FIG. 4 is a schematic perspective view of the second embodiment of flat cable and connector according to the invention. As pointed out above, the main body 10 of the connector 1 of this embodiment is provided with a single projection 13 substantially at the center of the part thereof for receiving a flat cable. The flat cable 2 of this embodiment is provided with a hole 23 at a position that corresponds to that of the projection 13.

The flat cable 2 comprises a flexible base member 21 and a plurality of wires 22 arranged in the flexible base member 21. The flexible base member 21 is electrically insulating and the plurality of wires 22 are insulated from each other by the flexible base member 21.

The hole 23 of the flat cable 2 is formed substantially at the center of the flexible base member 21 as viewed in a lateral direction thereof where the wires 22 of the flexible base member 21 are not arranged. As the flat cable 2 is inserted into the main body 10 of the connector 1 and the projection 13 of the connector 1 is inserted into the hole 23, the depth of insertion of the flat cable 2 in the connector 1 and the lateral positions of the inserted flat cable 2 relative to the connector 1 are automatically defined so that the wires 22 of the flat cable 2 are reliably held in contact with the corresponding respective contacts 12 of the connector 1. The projection 13 will be received reliably by the hole 23 of the flat cable 2 when the projection 13 of the connector 1 is tapered toward the front end thereof.

Figure 5:
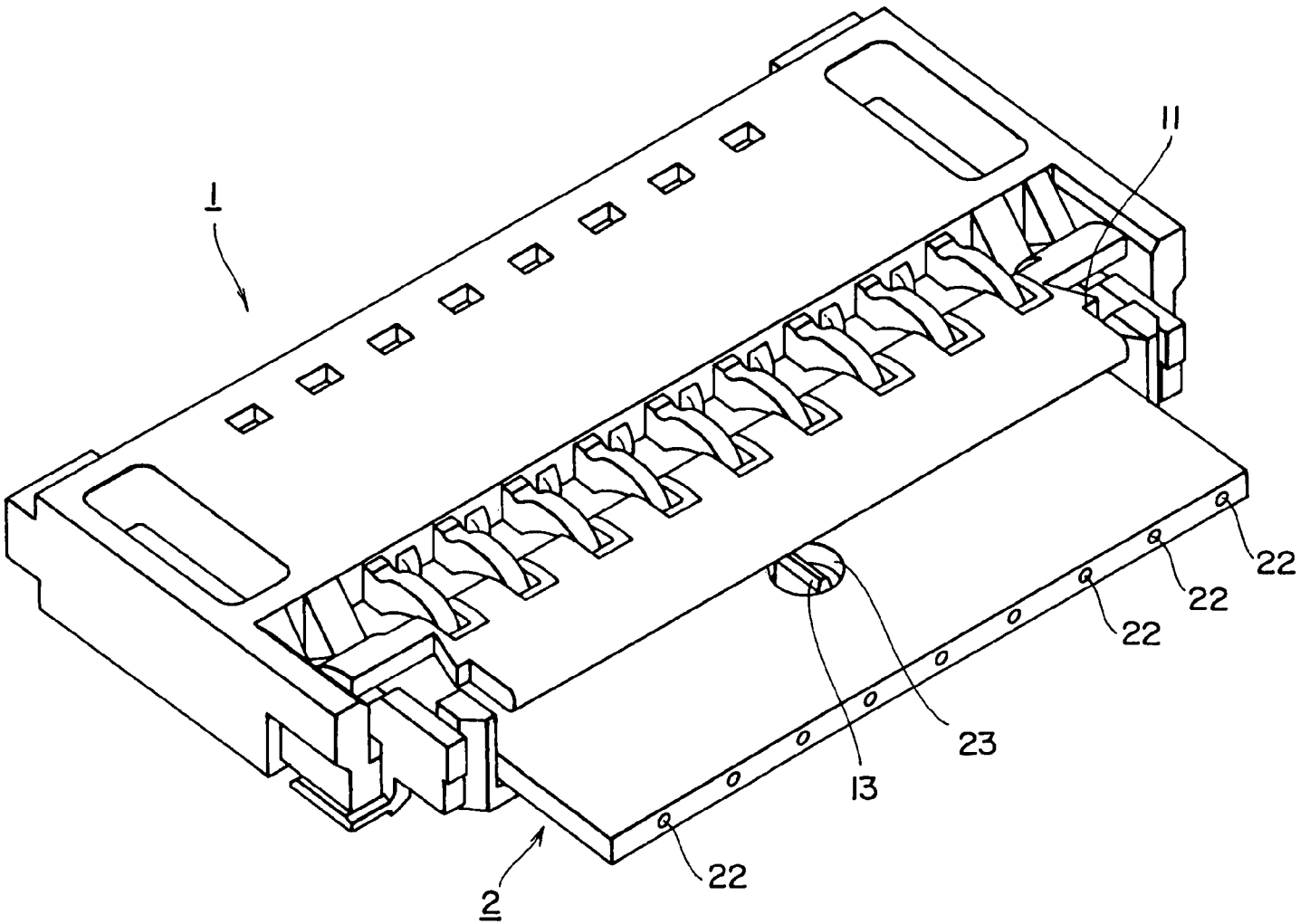
FIG. 5 is a schematic perspective view of the second embodiment of flat cable and connector in a state where the flat cable is inserted into the connector and rigidly held in position.

FIG. 5 is a schematic perspective view of the flat cable and connector in a state where the flat cable is inserted into the connector and rigidly held in position. As the pressurizing member 11 is closed after inserting the flat cable 2 into the connector 1 so as to bring the hole 23 into engagement with the projection 13, the flat cable 2 is pinched and reliably fitted to the connector 1 to produce a state where the flat cable 2 is accurately aligned with the connector 1.

If, on the other hand, the hole 23 of the flat cable 2 and the corresponding projection 13 of the connector 1 are not engaged (and the hole 23 is located off the corresponding projection 13), it is not possible to completely close the pressurizing member 11. Because the pressurizing member 11 cannot be closed unless the hole 23 of the flat cable 2 and the projection 13 of the connector 1 are engaged, the flat cable 2 is prevented from being rigidly fitted to the connector 1 in a state where it is incompletely inserted into the connector 1.

Figure 6:
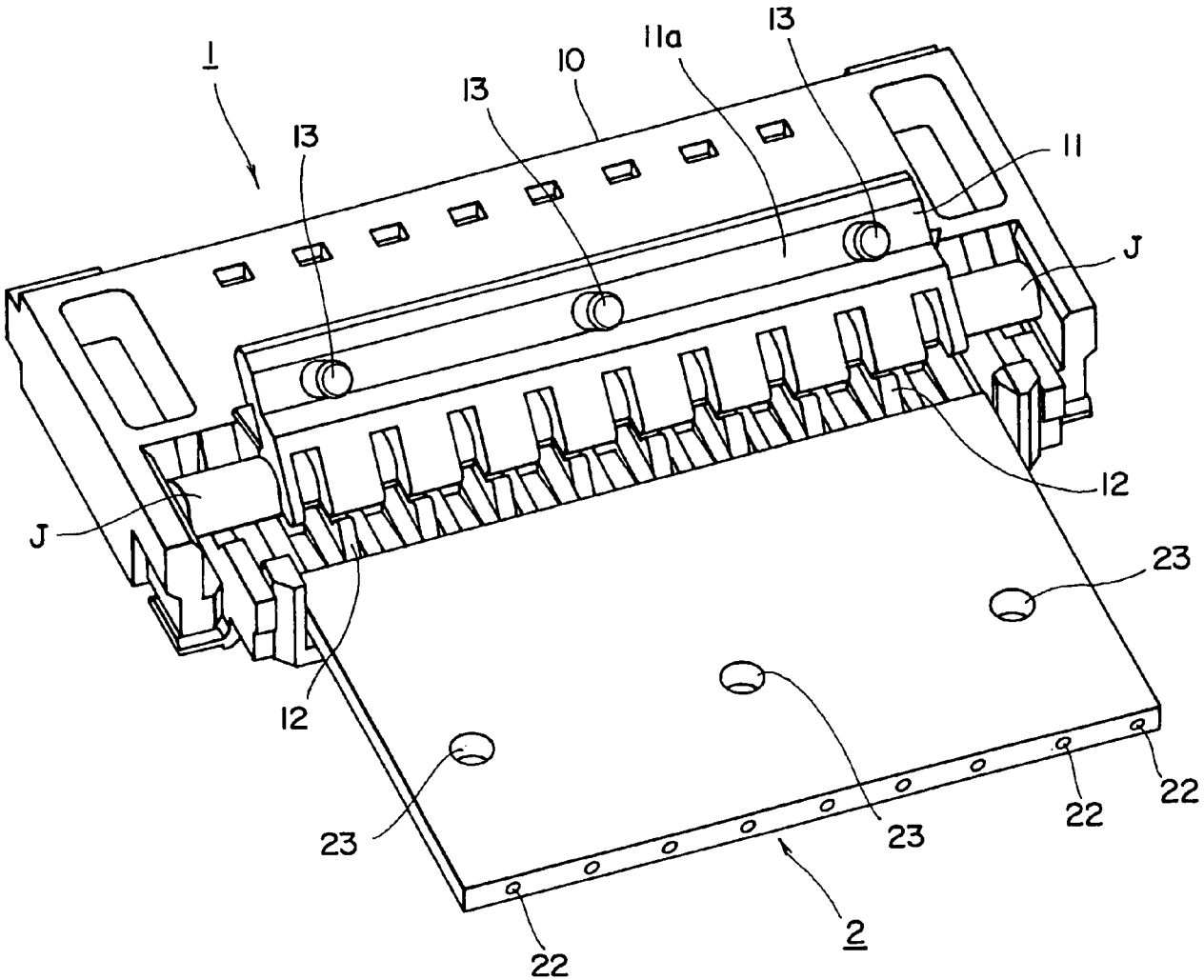
FIG. 6 is a schematic perspective view of the third embodiment of connector and flat cable according to the invention.

FIG. 6 is a schematic perspective view of the third embodiment of connector and flat cable according to the invention. Like the connector 1 of the above described first embodiment, the connector 1 comprises a main body 10 adapted to receive a flat cable 2, which will be described in greater detail hereinafter and is to be inserted into it, and a movable pressurizing member 11 adapted to press and rigidly hold the flat cable 2 in a state where the flat cable is inserted into the main body 10. However, this connector 1 is characterized in that the pressurizing member 11 is provided with three projections 13 to be used for aligning the connector 1 and the flat cable 2.

The main body 10 of the connector 1 of the third embodiment is also provided at the position for receiving the flat cable with contacts 12 to be used for establishing electric connection with the wires 22 of the flat cable 2. A plurality of contacts 12 are arranged so as to be insulated from each other and each of the contacts 12 has a bent and upwardly projecting profile so as to make itself resilient and operate like a spring. With this arrangement, when the flat cable 2 is inserted into the main body 10, the wires 22 of the flat cable 2 reliably contact the corresponding respective contacts 12 of the connector 1 due to the resiliency of the contacts 12.

The pressurizing member 11 has a keep plate 11*a*, which is opened and closed as the pressurizing member 11 is turned around an axis J. The flat cable is pinched in the main body 10 as the keep plate 11*a* of the pressurizing member 11 is closed so that the flat cable is reliably prevented from being pulled out.

The pressurizing member 11 of this embodiment is additionally provided with three projections 13 on the surface thereof that faces the flat cable 2 when it is closed. The projections 13 come to be engaged with the holes 23 arranged in the flat cable 2 when the flat cable 2 is inserted into the main body 10 and the pressurizing member 11 is closed.

On the other hand, the flat cable 2 of the third embodiment is provided with three holes 23 at positions corresponding to the respective projections 13 arranged on the pressurizing member 11 of the connector 1. The flat cable 2 comprises a flexible base member 21 and a plurality of wires 22 arranged in the flexible base member 21. The flexible base member 21 is electrically insulating and the plurality of wires 22 are insulated from each other by the flexible base member 21.

Figure 7:
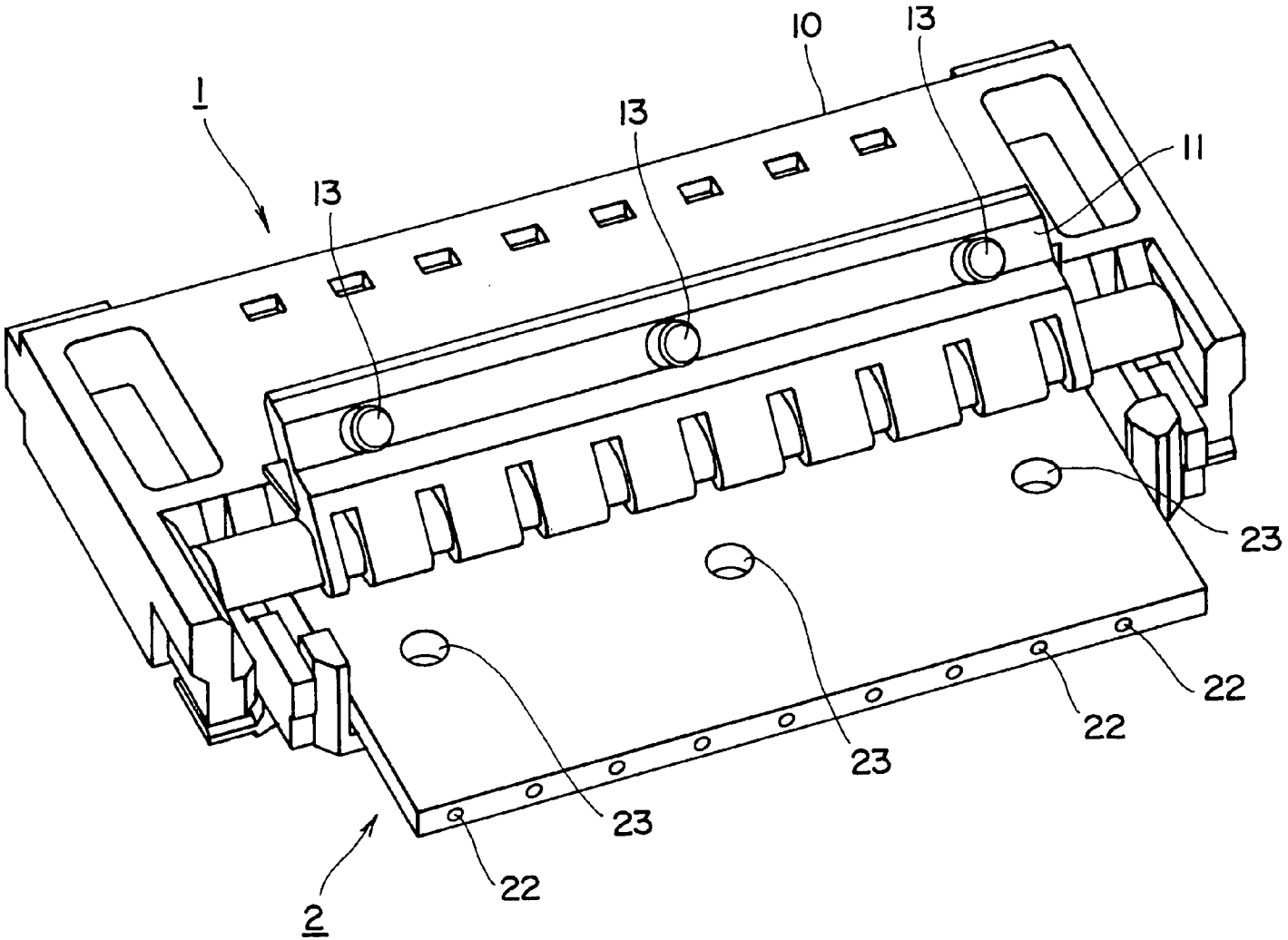
FIG. 7 is a schematic perspective view of the third embodiment of flat cable and connector in a state where the flat cable is inserted into the connector.

The holes 23 of the flat cable 2 are formed in areas where the wires 22 of the flexible base member 21 are not arranged. FIG. 7 is a schematic perspective view of the third embodiment of flat cable and connector when the flat cable is inserted into the connector. The flat cable 2 is inserted into the main body 10 of the connector 1 while the pressurizing member 11 is opened until it abuts the main body 10. In this operation of inserting the flat cable 2 into the connector 1, the resilience of the contacts (not shown) of the connector 1 is utilized to rigidly secure the flat cable 2 in position.

Figure 8:
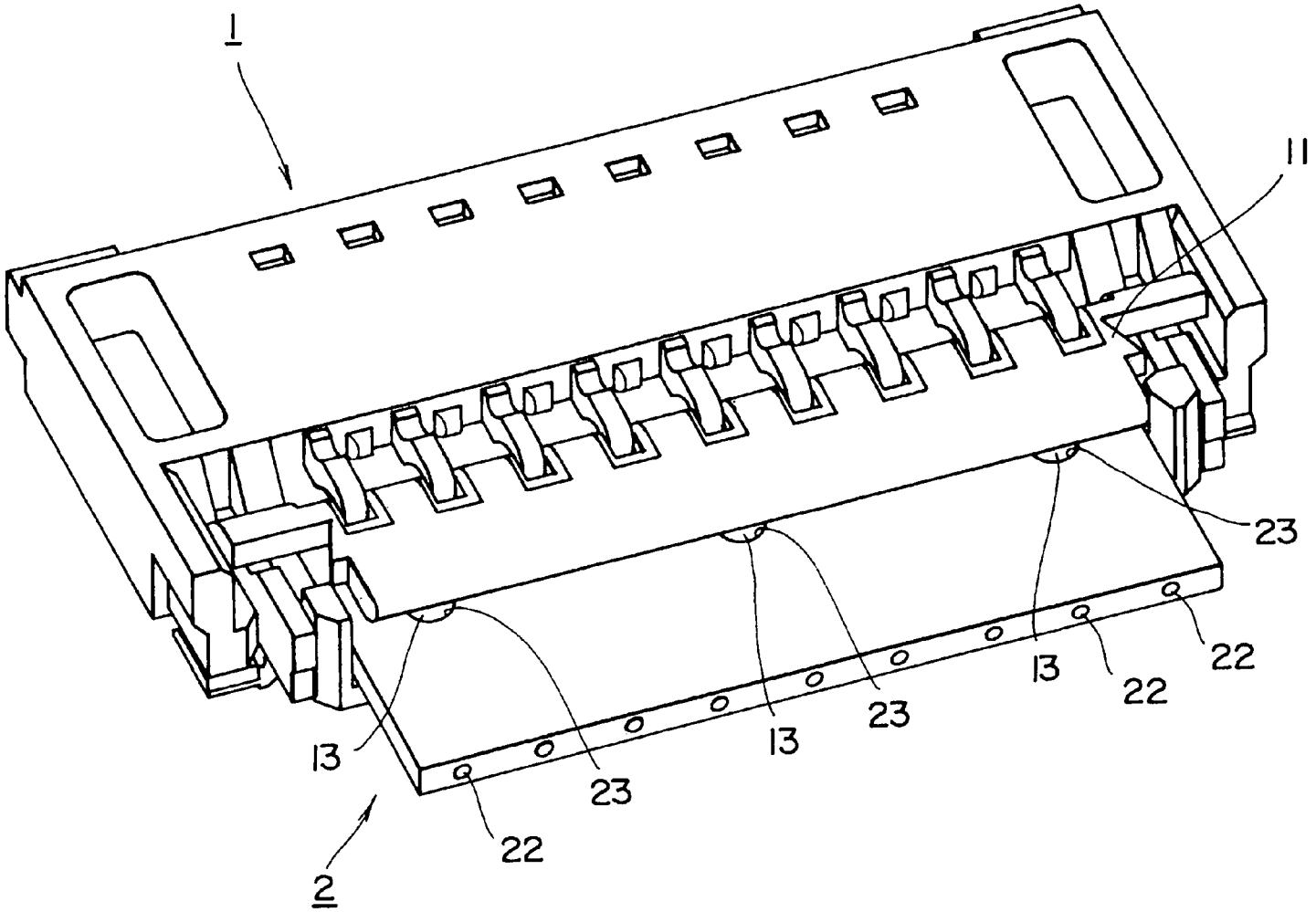
FIG. 8 is a schematic perspective view of the third embodiment of flat cable in a state where it is rigidly held in position.

FIG. 8 is a schematic perspective view of the third embodiment of flat cable in a state where it is rigidly held in position. As the flat cable 2 is inserted into the main body 10 of the connector 1 until it abuts the latter and the pressurizing member 11 is closed, the projections 13 arranged on the pressurizing member 11 come to be engaged with the corresponding respective holes 23 of the flat cable 2.

As a result of the engagement, the flat cable 2 and the connector 1 are accurately aligned relative to each other. At the same time, as the flat cable 2 is pinched by the pressurizing member 11 and rigidly held in position, the wires 22 of the flat cable 2 and the corresponding respective contacts 12 of the connector 1 are reliably held in contact and the flat cable 2 is prevented from being pulled out. The projections 13 will be received reliably by the respective holes 23 of the flat cable 2 when the projections 13 of the connector are tapered toward the front ends thereof.

If, on the other hand, the flat cable 2 is not inserted into the main body 10 of the connector 1 until it abuts the latter, the projections 13 and the corresponding respective holes 23 are not aligned properly when the pressurizing member 11 is closed so that consequently it is not possible to completely close the pressurizing member 11. Because the pressurizing member 11 cannot be closed unless the flat cable 2 is inserted accurately, the flat cable 2 is prevented from being rigidly fitted to the connector 1 in a state where it is incompletely inserted into the connector 1.

The number and positions of projections 13 and those of holes 23 of any of the above-described embodiments are not limited to those defined in the respective descriptions. Particularly, the number and the positions of the projections 13 of the connector 1 may be selected appropriately unless they do not significantly affect the size of the connector 1. The projections 13 may or may not be integrally formed with the main body 10 and other positional arrangements of the holes 13 are also possible.

In each of the above-described embodiments, the projection or projections 13 will be received reliably by the corresponding hole or the corresponding respective holes 23, whichever appropriate, of the flat cable 2 when the projection 13 of the connector 1 is or the projections of the connector 1 are tapered toward the front ends thereof.

Figure 9:
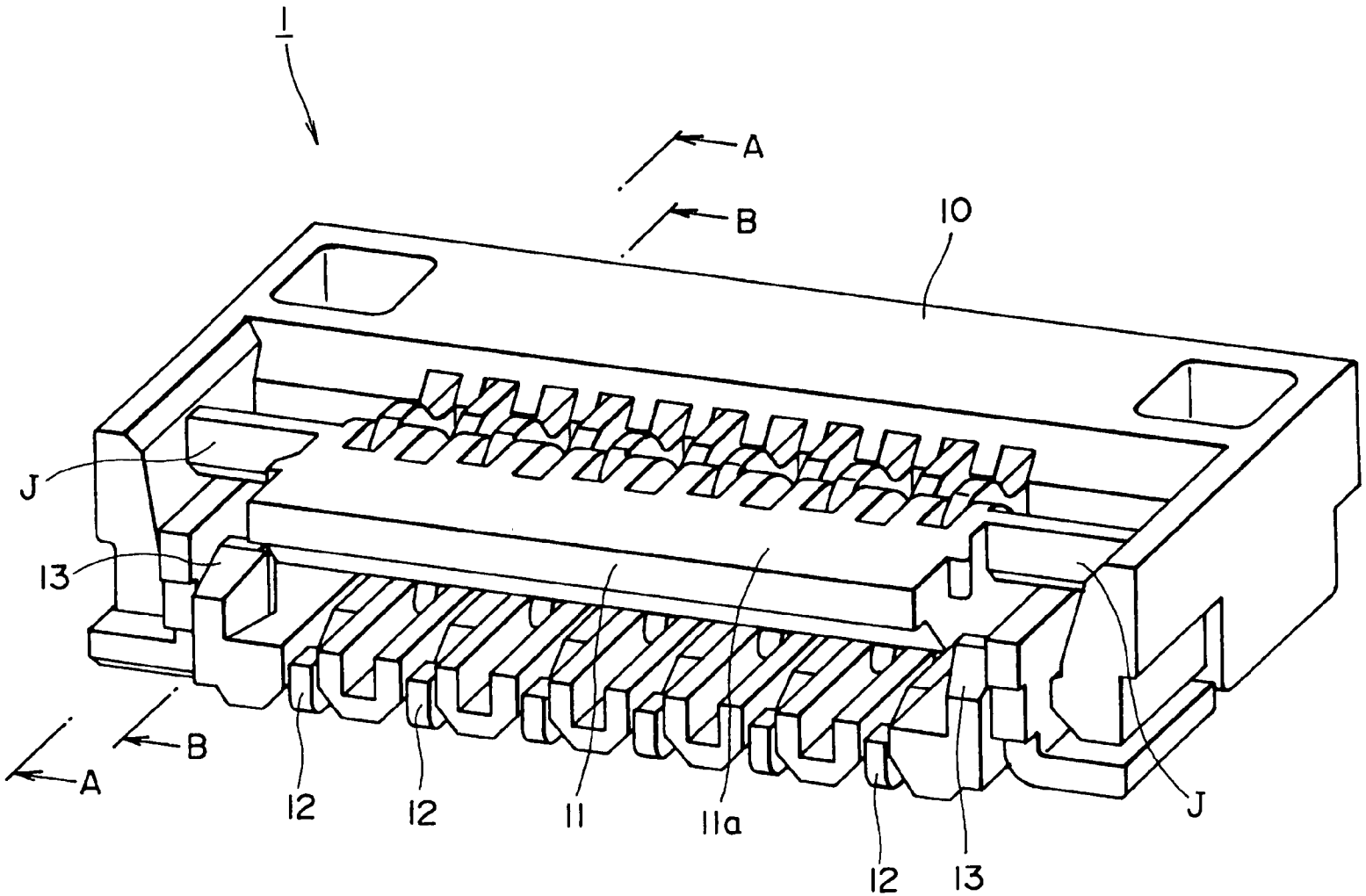
FIG. 9 is a schematic perspective view of the fourth embodiment of connector according to the invention.

FIG. 9 is a schematic perspective view of the fourth embodiment of connector according to the invention. Referring to FIG. 9, the connector 1 comprises a main body 10 adapted to receive a flat cable, a movable pressurizing member 11 adapted to press and rigidly hold the flat cable 2 in a state where the flat cable is inserted into the main body 10 and projections 13 to be used for aligning the connector 1 and the flat cable 2. In the fourth embodiment, the connector 1 is additionally provided with lateral projections 13 at respective positions located in the part for receiving the flat cable inserted into it.

The main body 10 of the connector 1 of the fourth embodiment is also provided at the position for receiving the flat cable with contacts 12 to be used for establishing electric connection with the wires 22 of the flat cable 2. A plurality of contacts 12 are arranged so as to be insulated from each other and each of the contacts 12 has a bent and upwardly projecting profile so as to make itself resilient and operate like a spring. With this arrangement, when the flat cable 2 is inserted into the main body 10, the wires 22 of the flat cable 2 reliably contact the corresponding respective contacts 12 of the connector 1 due to the resiliency of the contacts 12.

The pressurizing member 11 has a keep plate 11*a*, which is opened and closed as the pressurizing member 11 is turned around an axis J. The flat cable is pinched in the main body 10 as the keep plate 11*a* of the pressurizing member 11 is closed so that the flat cable is reliably prevented from being pulled out.

Figure 10A:
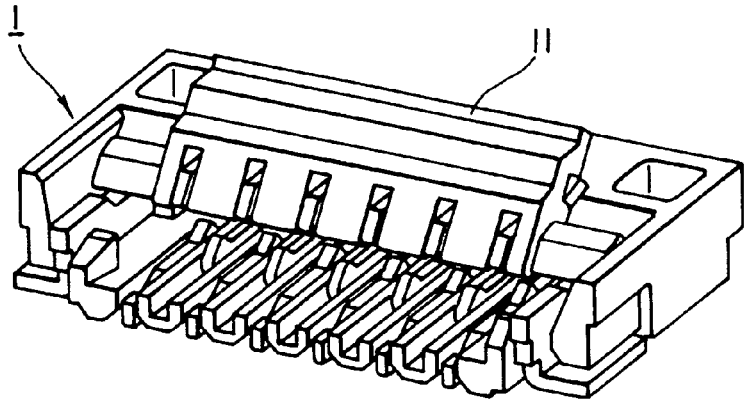
FIGS. 10A, 10B and 10C are schematic perspective views of the fourth embodiment of flat cable and connector according to the invention, showing how they are connected to each other.
Figure 10B:
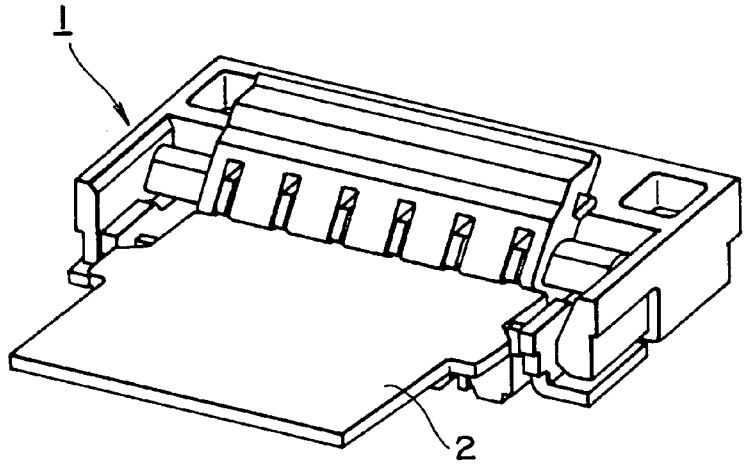
Figure 10C:
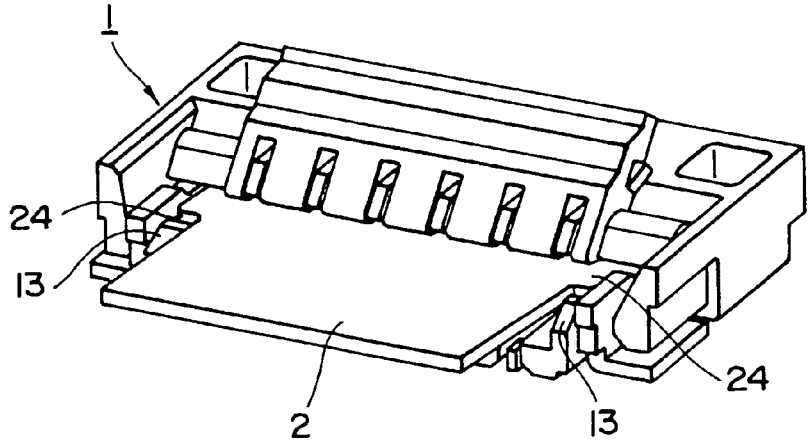

FIGS. 10A, 10B and 10C are schematic perspective views of the fourth embodiment of flat cable and connector according to the invention, showing how the flat cable is inserted into the connector. Firstly, the pressurizing member 11 of the connector 1 is held open as shown in FIG. 10A. Then, the flat cable 2 is inserted into the flat cable receiving port of the connector 1 from the front end thereof as shown in FIG. 10B.

Thereafter, as the front end of the flat cable 2 is pushed further into the connector 1, the lateral extended sections 24 of the flat cable 2 ride over the corresponding respective projections 13 of the connector 1 as shown in FIG. 10C. As a result, the extended sections 24 of the flat cable 2 are engaged with the corresponding respective projections 13 of the connector 1 to align the flat cable 2 relative to the connector 1. As the pressurizing member 11 is closed under this condition, the flat cable 2 is pressed so as to be rigidly held in position and the wires of the flat cable 2 are brought into contact with the corresponding respective contacts 12 of the connector 1.

Figure 11A:
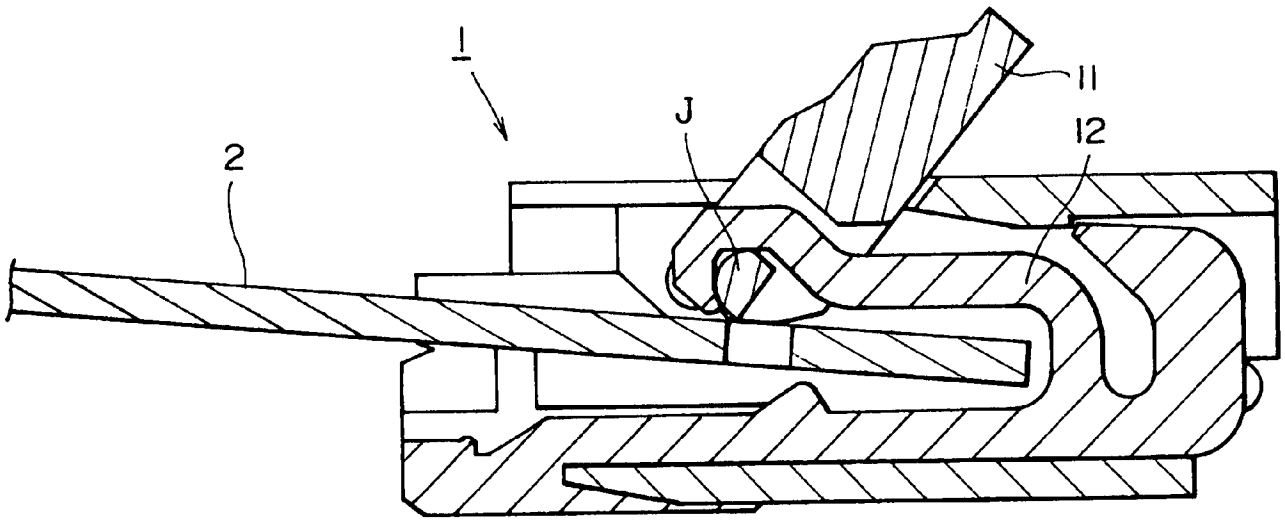
FIGS. 11A and 11B are schematic cross sectional views of the fourth embodiment of connector in a state where the pressurizing member is opened.
Figure 11B:
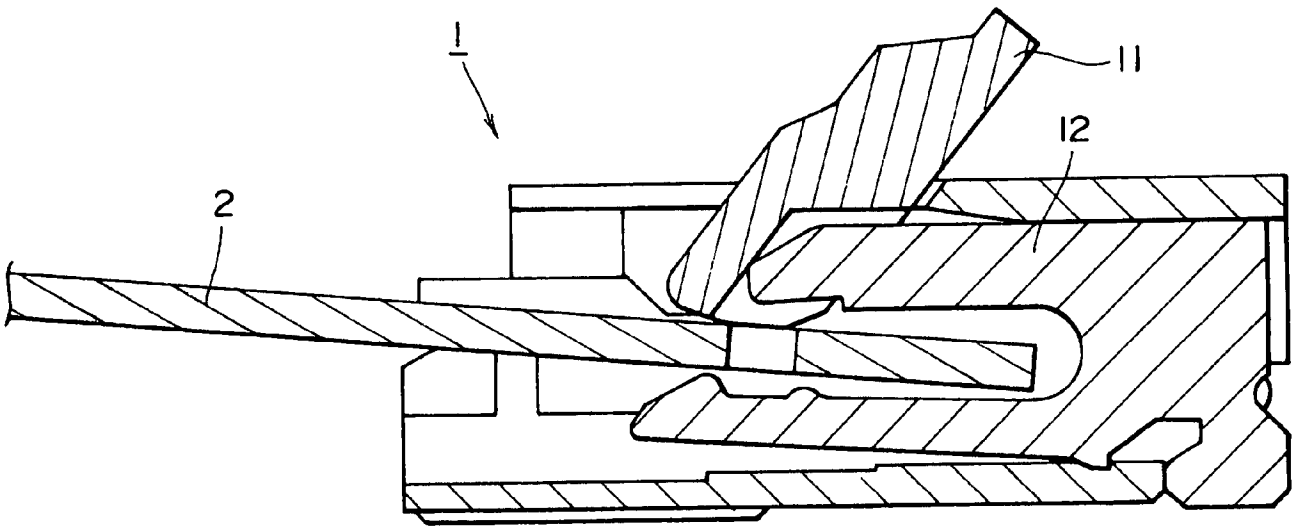
Figure 12A:
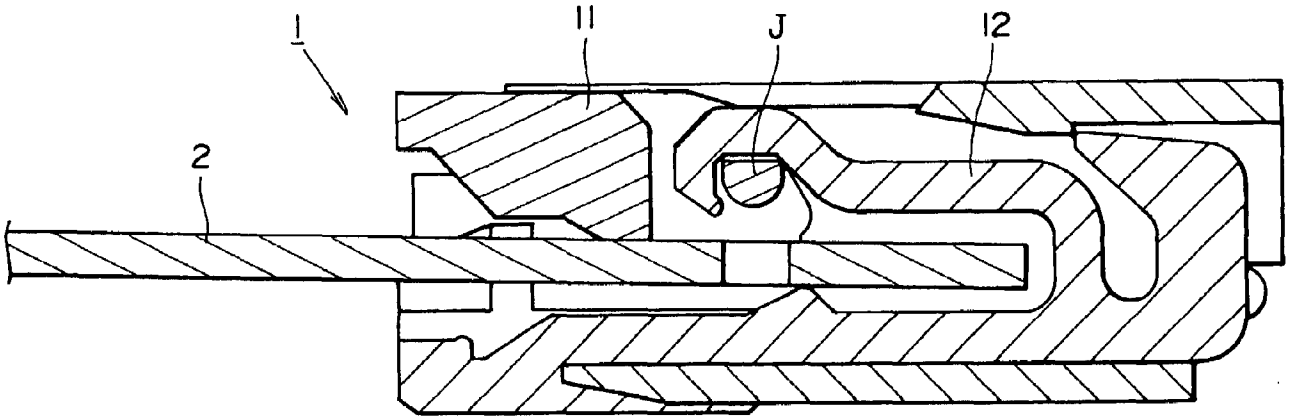
FIGS. 12A and 12B are schematic cross sectional views of the fourth embodiment of connector in a state where the pressurizing member is closed.
Figure 12B:
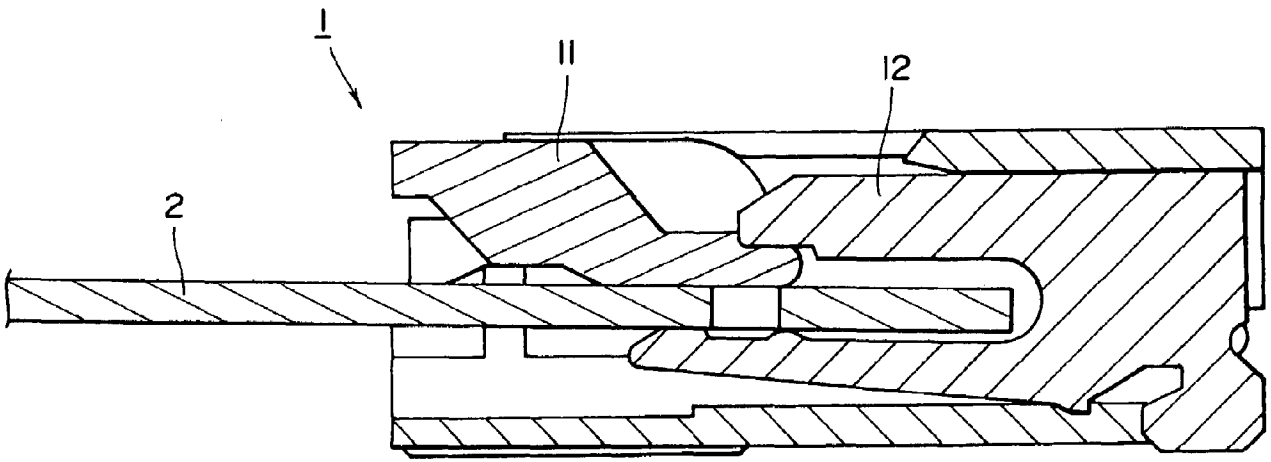

FIGS. 11A and 11B are schematic cross sectional views of the fourth embodiment of connector in a state where the pressurizing member is opened and FIGS. 12A and 12B are schematic cross sectional views of the fourth embodiment of connector in a state where the pressurizing member is closed. Note that FIGS. 11A and 12A are cross sectional views taken along line A—A in FIG. 9, whereas FIGS. 11B and 12B are cross sectional views taken along line B—B in FIG. 9. In the connector 1 of this embodiment, contacts of two different types including the contacts 12 shown in FIGS.

11A, 12A and the contacts 12 shown in FIGS. 11B, 12B are arranged alternately at a fine pitch.

In a state where the pressurizing member 11 is opened as shown in FIGS. 11A and 11B, the contacts 12 of the connector 1 do not limit the port for receiving the flat cable 2 so that the flat cable 2 can be inserted into the connector 1 obliquely from upward.

As the flat cable 2 is inserted into the connector 1, the extended sections of the flat cable 2 come into engagement with the corresponding respective projections of the connector 1. Since the extended sections are arranged at the lateral sides of the flat cable 2 and the projections are also arranged laterally at the flat cable receiving port of the connector 1, the flat cable 2 is reliably inserted into and held in position in the connector 1 as the pair of extended sections and the corresponding respective projections are engaged.

As the pressurizing member 11 is turned and closed as shown in FIG. 12 under this condition, the front end of the pressurizing member 11 acts on the flat cable 2 so as to press it downward. Then, the contacts 12 of the connector 1 are brought into contact with the corresponding respective wires of the flat cable 2 to slightly bite the latter.

As the pressurizing member 11 is completely closed, the upper surface of the connector 1 becomes flat. Additionally, the openings of the contacts 12 in the connector 1 can be narrowed by the pressurizing member 11 so as to be able to pinch the flat cable 2 between the pressurizing member 11 and the contacts 12. As a result, the front end of the flat cable 2 and the connector 1 are reliably brought into contact with each other.

Figure 13A:
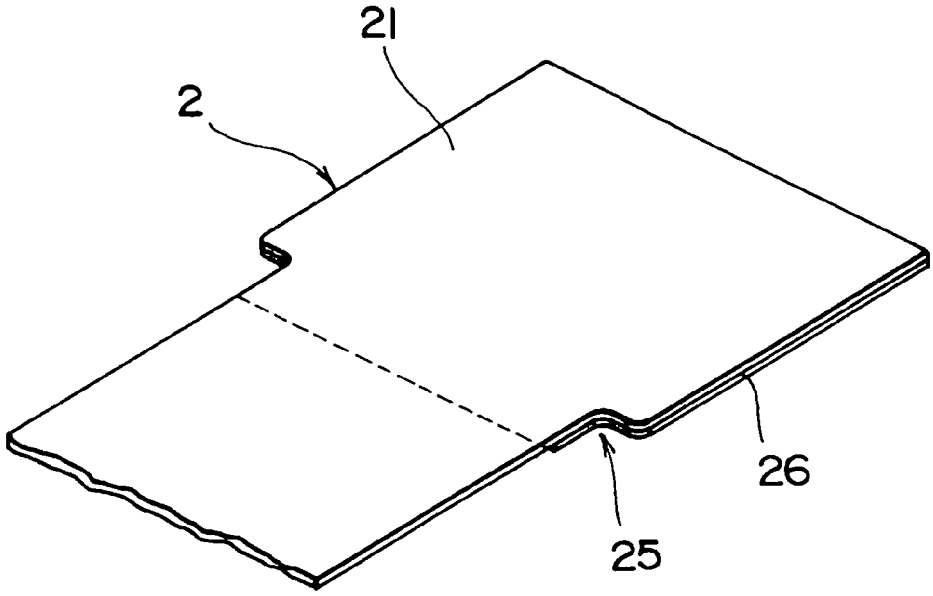
FIGS. 13A, 13B and 13C are schematic illustrations of the fifth embodiment of flat cable according to the invention.
Figure 13B:
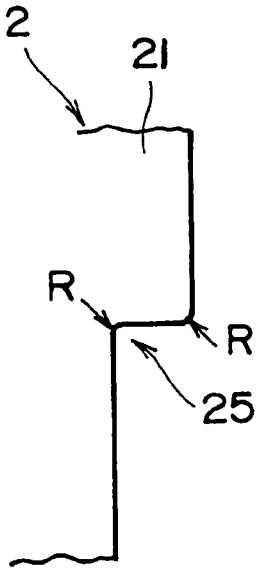
Figure 13C:
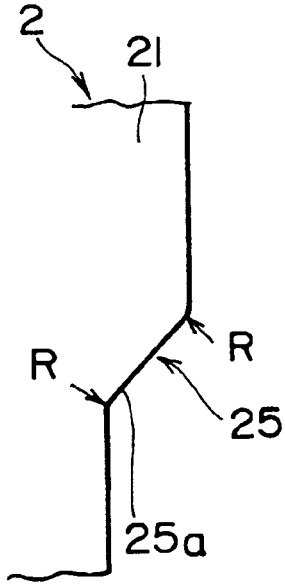

FIGS. 13A, 13B and 13C are schematic illustrations of the fifth embodiment of flat cable according to the invention. FIG. 13A is a schematic perspective view of the fifth embodiment of flat cable. Referring to FIG. 13A, the flat cable 2 of the fifth embodiment is characterized in that the flexible base member 21 thereof is provided with lateral stepped sections 25 that are to be brought into engagement with the corresponding respective projections arranged on an external connector when the flat cable 2 is inserted into the connector.

The stepped sections 25 may show a profile as shown in FIG. 13B. More specifically, the stepped sections 25 are formed as the flexible base member 21 is narrowed from a middle part thereof. The corners of the stepped sections 25 are rounded to allow the stepped sections 25 to be smoothly engaged with the corresponding respective projections of the connector.

The stepped sections 25 may alternatively show a profile as shown in FIG. 13C. More specifically, the stepped sections are formed as tapered sections 25*a* extend from a middle part of the flexible base member 21. Then, the projections of the connector 1 are made to show a profile corresponding to the profile of the tapered sections 25*a*. Due to the tapered sections 25*a*, the flexible base member 21 gradually reduces its width so that the flexible base member 21 is prevented from being bent. The corners of the stepped sections 25 are also rounded to allow the stepped sections 25 to be smoothly engaged with the corresponding respective projections of the connector.

The flat cable 2 is provided with stepped sections 25 having a relatively simple profile for engagement with the corresponding respective projections of the connector. In other words, the flat cable 2 does not need to have a complex alignment mechanism and hence can be manufactured with ease.

Additionally, the flexible base member 21 of the flat cable 2 is provided at the side thereof to be inserted into the connector with a reinforcement member 26. The reinforcement member 26 is typically made of polyimide or PET (polyethylene terephthalate) and extends from the leading end to be inserted into the connector to a line beyond the stepped sections 25. With this arrangement, the flat cable 2 is prevented from buckling when it is inserted into the connector. It should be noted here that the provision of such a reinforcement member 26 is not limited to the fifth embodiment and the flat cable of any of the other embodiments may also be provided with such a reinforcement member.

Figure 14A:
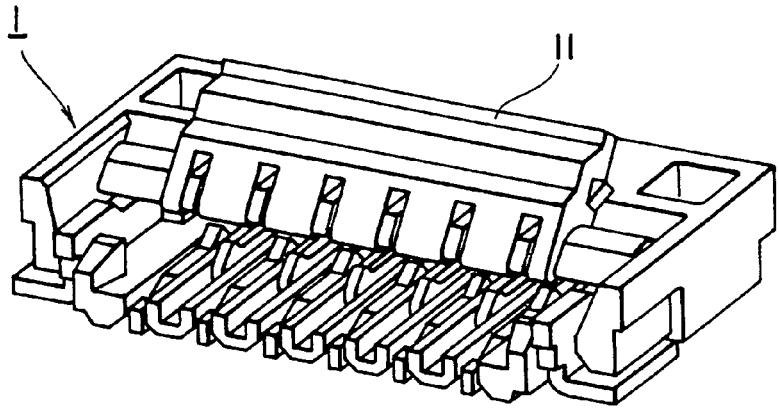
FIGS. 14A, 14B and 14C are schematic perspective views of the fifth embodiment of flat cable, showing how it is inserted into a corresponding connector.
Figure 14B:
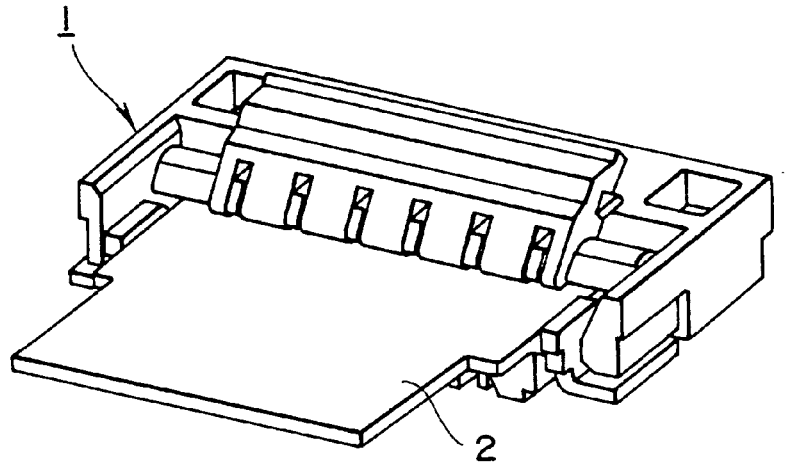
Figure 14C:
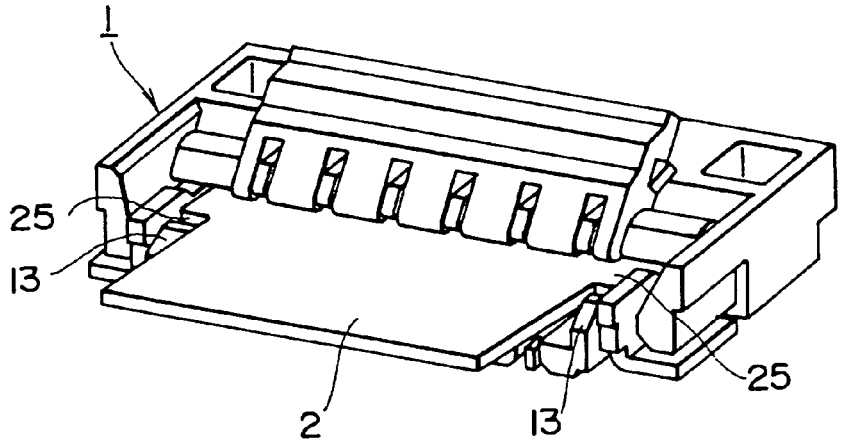

FIGS. 14A, 14B and 14C are schematic perspective views of the fifth embodiment of flat cable, showing how it is inserted into a corresponding connector. Firstly, the pressurizing member 11 of the connector 1 is held open as shown in FIG. 14A. Then, the flat cable 2 is inserted into the flat cable receiving port of the connector 1 from the front end thereof as shown in FIG. 14B.

Thereafter, as the front end of the flat cable 2 is pushed further into the connector 1, the lateral stepped sections 25 of the flat cable 2 ride over the corresponding respective projections 13 of the connector 1 as shown in FIG. 14C. As a result, the stepped sections 25 of the flat cable 2 are engaged with the corresponding respective projections 13 of the connector 1 to align the flat cable 2 relative to the connector 1. As the pressurizing member 11 is closed under this condition, the flat cable 2 is pressed so as to be rigidly held in position and the wires of the flat cable 2 are brought into contact with the corresponding respective contacts 12 of the connector 1.

Figure 15A:
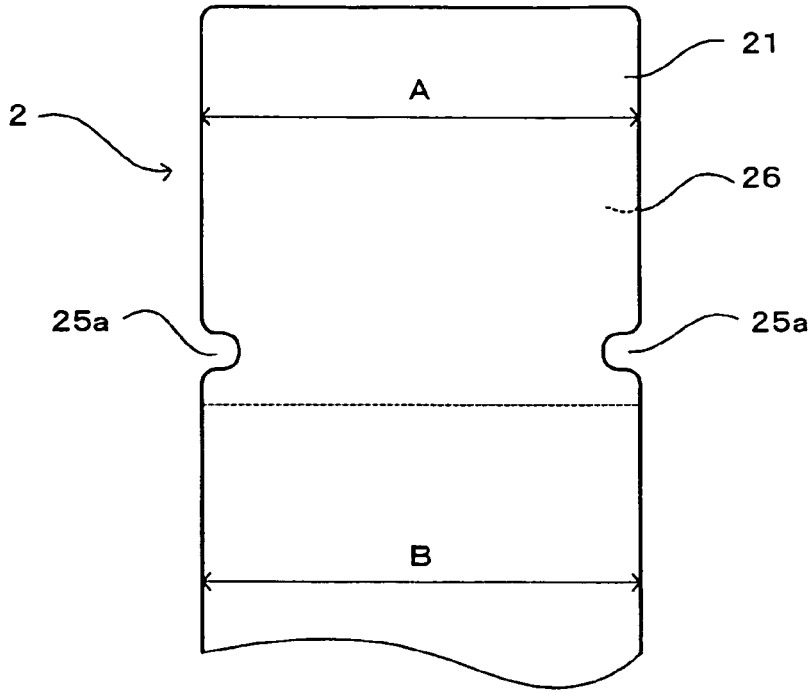
FIGS. 15A and 15B are schematic plan views of the stepped sections of modified embodiments of flat cable according to the invention.
Figure 15B:
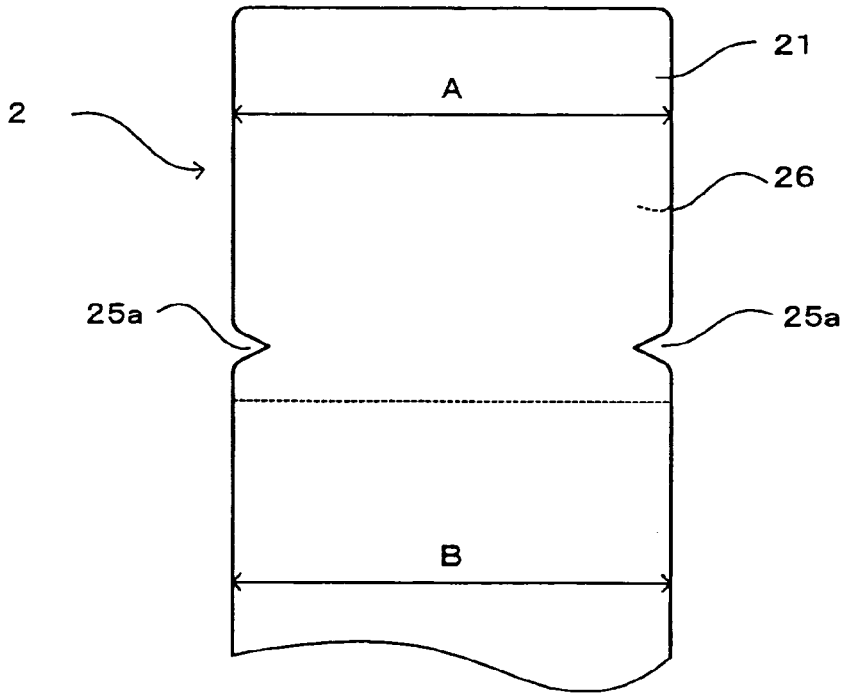

FIGS. 15A and 15B are schematic plan views of the stepped sections of modified embodiments of flat cable according to the invention. The flexible base member 21 of the flat cable 2 illustrated in FIG. 15A is provided with lateral recesses 25*a* as stepped sections. As in the case of the above-described fifth embodiment, the flexible base member 21 of the flat cable 2 is provided at the side thereof to be inserted into the connector with a reinforcement member 26. The reinforcement member 26 extends from the leading end to be inserted into the connector to a line beyond the stepped sections. With this arrangement, the flat cable 2 is prevented from buckling when it is inserted into the connector.

The flexible base member 21 of the flat cable 2 illustrated in FIG. 15B is provided with V-shaped notches as lateral recesses 25*a*. As in the case of the above-described fifth embodiment, the flexible base member 21 of the flat cable 2 is provided at the side thereof to be inserted into the connector with a reinforcement member 26.

In both of the modified embodiments of flat cable 2, the flexible base member 21 is provided with lateral stepped sections in the form of lateral recesses 25*a* so that the recesses 25*a* are engaged with the corresponding respective projections of the connector to align the flat cable 2 relative to the connector as the flat cable 2 is inserted into the connector.

While both the front part and the rear part relative to the recesses 25*a* of each of the flat cables 2 of FIGS. 15A and 15B have a same width (as indicated by A and B in FIGS. 15A and 15B), the widths may be differentiated to show a relationship of A <B or A >B.

A connector 1 and a flat cable 2 according to the invention can be used to connect various circuit boards. Particularly, many electronic devices (mobile phones, note-type computers) have a main body and a display unit that are connected to each other by means of a hinge so as to allow the display unit to turn (to be opened and closed) relative to the main body or vice versa. Thus, these components can be reliably electrically connected to each other by using a connector 1 and a flat cable 2 according to the invention.

The circuit board of the electronic device is electrically connected to some other circuit board when a connector 1 according to the invention is fitted to the circuit board of the electronic device so as to receive a flat cable 2 according to the invention.

What is claimed is:

1. An electronic device comprising:

a cable comprising a plurality of wires disposed in an insulative material, the insulative material comprising first and second voids; and a connector comprising a body configured to receive a portion of the cable;

a rotatable member positionable to secure the cable in the body; and first and second fixed projections disposed on the body, the fixed projections configured to be disposed in the voids of the cable when the cable is received in the body, wherein the fixed projections extend from a contact surface of the body, the contact surface disposed opposite a pressing surface of the rotatable member, the contact and pressing surfaces configured to retain the cable therebetween.

2. The electronic device according to claim 1, wherein the pressing surface of the rotatable member comprises a plurality of surfaces configured to press the cable.

3. The electronic device according to claim 1, wherein the connector comprises a plurality of contacts disposed in openings in the contact surface, the contacts extending above the contact surface.

4. The electronic device according to claim 3, wherein the contacts are disposed between the first and second fixed projections.

5. The electronic device according to claim 4, wherein the wires of the cable are disposed between the first and second voids.

* * * * *